US009816340B2

(12) United States Patent
Fripp et al.

(10) Patent No.: US 9,816,340 B2
(45) Date of Patent: Nov. 14, 2017

(54) DECOMPOSING ISOLATION DEVICES CONTAINING A BUFFERING AGENT

(71) Applicant: HALLIBURTON ENERGY SERVICES, INC., Houston, TX (US)

(72) Inventors: Michael L. Fripp, Carrollton, TX (US); Zachary W. Walton, Carrollton, TX (US); Zachary R. Murphree, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/406,586

(22) PCT Filed: Jan. 13, 2014

(86) PCT No.: PCT/US2014/011311

§ 371 (c)(1),
(2) Date: Dec. 9, 2014

(87) PCT Pub. No.: WO2015/105515

PCT Pub. Date: Jul. 16, 2015

(65) Prior Publication Data

US 2016/0305209 A1 Oct. 20, 2016

(51) Int. Cl.

| | |
|---|---|
| ***E21B 33/12*** | (2006.01) |
| ***E21B 29/02*** | (2006.01) |
| ***E21B 33/16*** | (2006.01) |
| ***E21B 33/134*** | (2006.01) |
| *E21B 43/08* | (2006.01) |

(52) U.S. Cl.

CPC ..... *E21B 29/02* (2013.01); *E21B 33/12* (2013.01); *E21B 33/1208* (2013.01); *E21B 33/134* (2013.01); *E21B 33/16* (2013.01); *E21B 43/08* (2013.01)

(58) Field of Classification Search

CPC ..... E21B 33/1204; E21B 33/1208; E21B 33/00–33/16; E21B 29/00–29/12; E21B 43/08–43/088; E21B 34/00; E21B 34/06–34/108

USPC ..... 166/376, 317

See application file for complete search history.

(56) References Cited

U.S. PATENT DOCUMENTS

| | | | |
|---|---|---|---|
| 7,699,101 | B2 | 4/2010 | Fripp et al. |
| 8,424,610 | B2 | 4/2013 | Newton et al. |
| 2004/0163813 | A1 | 8/2004 | Slabaugh et al. |

(Continued)

FOREIGN PATENT DOCUMENTS

| | | | |
|---|---|---|---|
| WO | WO2013089941 | A1 | 6/2013 |

OTHER PUBLICATIONS

European Search Report dated Apr. 21, 2017; European Patent Application No. 14878117.2.

*Primary Examiner* — George Gray
(74) *Attorney, Agent, or Firm* — McGuireWoods LLP

(57) ABSTRACT

A wellbore isolation device includes a substance; and a pH maintainer, wherein the pH maintainer maintains the pH of a wellbore fluid surrounding the isolation device at a desired pH or range of pH values for a desired period of time, and wherein the substance is capable of decomposing at the desired pH or range of pH values. A method of removing the wellbore isolation device includes placing the isolation device into the wellbore; and causing or allowing at least a portion of the substance to decompose.

16 Claims, 2 Drawing Sheets

(56) References Cited

U.S. PATENT DOCUMENTS

| | | | | |
|---|---|---|---|---|
| 2007/0044958 | A1 | 3/2007 | Rytlewski et al. | |
| 2009/0101334 | A1 | 4/2009 | Baser et al. | |
| 2012/0214715 | A1 | 8/2012 | Luo et al. | |
| 2012/0318513 | A1 | 12/2012 | Mazyar et al. | |
| 2013/0081801 | A1* | 4/2013 | Liang | C09D 5/008 166/192 |
| 2013/0146312 | A1* | 6/2013 | Gerrard | C09K 8/44 166/387 |
| 2013/0160992 | A1* | 6/2013 | Agrawal | E21B 23/04 166/193 |
| 2013/0240203 | A1 | 9/2013 | Frazier | |
| 2013/0292123 | A1* | 11/2013 | Murphree | E21B 34/14 166/308.1 |

* cited by examiner

DECOMPOSING ISOLATION DEVICES CONTAINING A BUFFERING AGENT

TECHNICAL FIELD

Isolation devices can be used to restrict fluid flow between intervals of a wellbore. An isolation device can be removed from a wellbore after use. Methods of removing an isolation device using a pH maintainer to allow at least one substance of the isolation device to decompose are provided.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
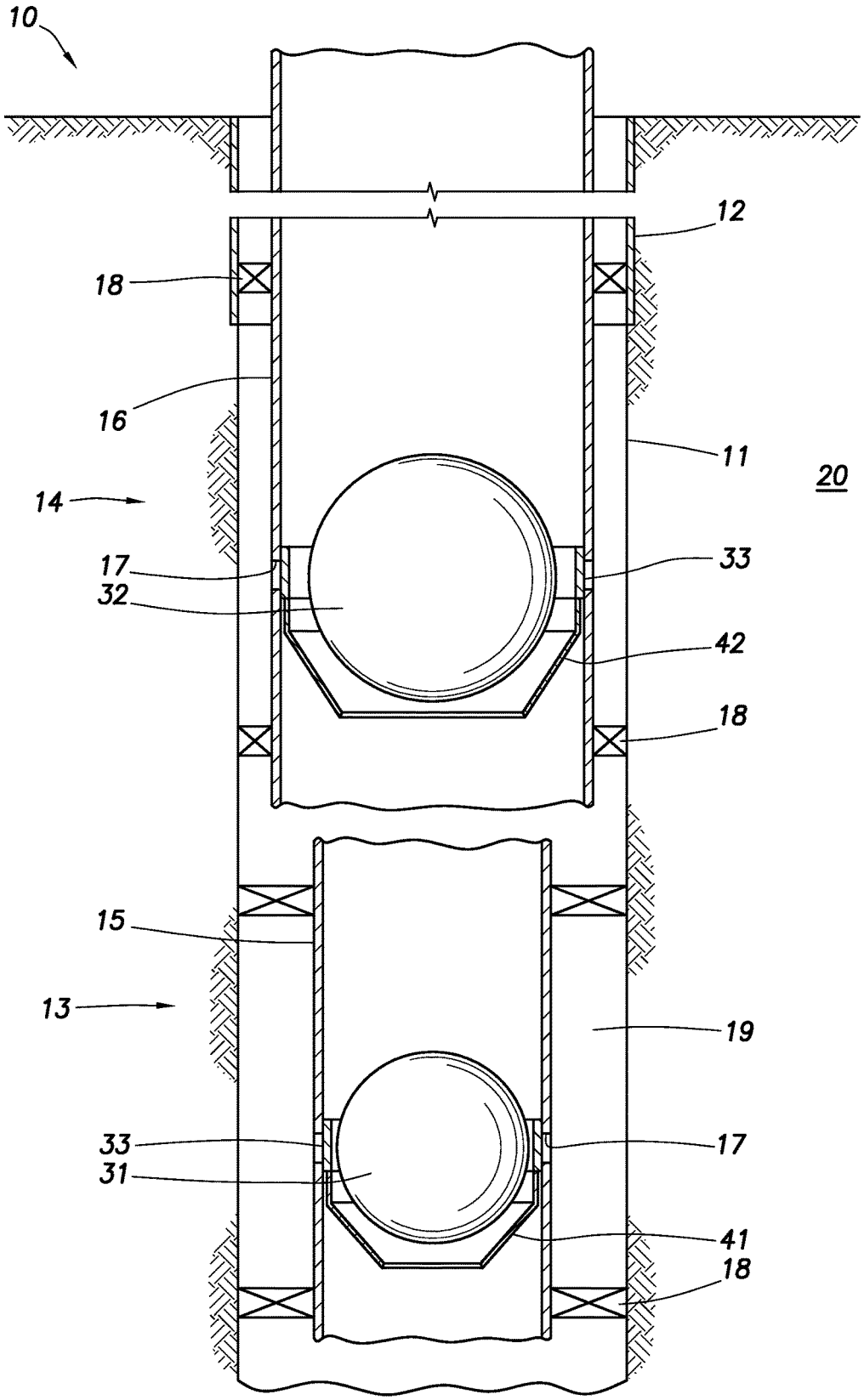
FIG. 1 is a schematic illustration of a well system containing more than one isolation device.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more substances, layers, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device. An isolation device can be used for zonal isolation and functions to block fluid flow within a tubular, such as a tubing string, or within an annulus. The blockage of fluid flow prevents the fluid from flowing into the zones located below the isolation device and isolates the zone of interest. As used herein, the relative term "below" means at a location further away from a wellhead and "above" means at a location closer to the wellhead compared to a reference object. In this manner, treatment techniques can be performed within the zone of interest.

Common isolation devices include, but are not limited to, a ball, a plug, a bridge plug, a wiper plug, and a packer. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished, for example, via a ball and seat by dropping the ball from the wellhead onto the seat that is located within the wellbore. The ball engages with the seat, and the seal created by this engagement prevents fluid communication into other zones downstream of the ball and seat. In order to treat more than one zone using a ball and seat, the wellbore can contain more than one ball seat. For example, a seat can be located within each zone. Generally, the inner diameter (I.D.) of the ball seats are located is different for each zone. For example, the I.D. of the ball seats sequentially decrease at each zone, moving from the wellhead to the bottom of the well. In this manner, a smaller ball is first dropped into a first zone that is the farthest downstream; that zone is treated; a slightly larger ball is then dropped into another zone that is located upstream of the first zone; that zone is then treated; and the process continues in this fashion—moving upstream along the wellbore—until all the desired zones have been treated. As used herein, the relative term "upstream" means at a location closer to the wellhead.

A bridge plug is composed primarily of slips, a plug mandrel, and a rubber sealing element. A bridge plug can be introduced into a wellbore and the sealing element can be caused to block fluid flow into downstream zones. A packer generally consists of a sealing device, a holding or setting device, and an inside passage for fluids. A packer can be used to block fluid flow through the annulus located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more zones. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device or the entire device. Yet, another way to remove an isolation device is to contact the device with a solvent, such as an acid, thus dissolving all or a portion of the device.

However, some of the disadvantages to using traditional methods to remove a retrievable isolation device include: it can be difficult and time consuming to use a retrieval tool; milling can be time consuming and costly; and premature dissolution of the isolation device can occur. For example, premature dissolution can occur if acidic fluids are used in the well prior to the time at which it is desired to dissolve the isolation device.

It is often desirable to cause or allow portions of an isolation device to decompose or degrade down hole after use. One or more substances making up the isolation device can undergo chemical decomposition; thereby allowing the isolation device to be removed or flowed from the wellbore. This allows fluid communication to be restored between wellbore intervals. However, as the substances decompose during the chemical reaction, the pH of the surrounding fluid can change. The pH can become more acidic or more basic during the reaction. Depending on how much the pH changes during the reaction, the system can become saturated to the point that the reaction either stops or the reaction rate decreases to an undesirable rate.

Common decomposition reactions include hydrolysis, oxidation-reduction reactions, and galvanic corrosion. Some substances can also decompose due to acid-base reactions. Hydrolysis is the cleavage of chemical bonds with the addition of water. Typically, wellbore fluids include water, so hydrolysis can be a common chemical decomposition reaction. In oxidation-reduction "Redox" reactions, one element or molecule losses electrons and another element or molecule gains electrons.

Galvanic corrosion occurs when two different metals or metal alloys are in electrical connectivity with each other and both are in contact with an electrolyte. As used herein, the phrase "electrical connectivity" means that the two different metals or metal alloys are either touching or in close enough proximity to each other such that when the two different metals are in contact with an electrolyte, the electrolyte becomes electrically conductive and ion migration occurs between one of the metals and the other metal, and is not meant to require an actual physical connection between the two different metals, for example, via a metal wire. It is to be understood that as used herein, the term "metal" is meant to include pure metals and also metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

The metal that is less noble, compared to the other metal, will dissolve in the electrolyte. The less noble metal is often referred to as the anode, and the more noble metal is often referred to as the cathode. Galvanic corrosion is an electrochemical process whereby free ions in the electrolyte make the electrolyte electrically conductive, thereby providing a means for ion migration from the anode to the cathode—resulting in deposition formed on the cathode. Metals can be arranged in a galvanic series. The galvanic series lists metals in order of the most noble to the least noble. An anodic index lists the electrochemical voltage (V) that develops between a metal and a standard reference electrode (gold (Au)) in a given electrolyte. A metal that has an anodic index greater than another metal is more noble than the other metal and will function as the cathode. Conversely, the metal that has an anodic index less than another metal is less noble and functions as the anode.

There is a need to provide an efficient and cost-effective way to maintain and/or control the rate of decomposition reactions of substances making up an isolation device. It has been discovered that a pH maintainer can be added to the isolation device. The pH maintainer can maintain the pH of the surrounding fluid at a desired pH or range of pH values.

According to an embodiment, a wellbore isolation device comprises: a substance; and a pH maintainer, wherein the pH maintainer maintains the pH of a wellbore fluid surrounding the isolation device at a desired pH or range of pH values for a desired period of time, and wherein the substance is capable of decomposing at the desired pH or range of pH values.

According to another embodiment, a method of removing the wellbore isolation device comprises: placing the isolation device into the wellbore; and causing or allowing at least a portion of the substance to decompose.

Any discussion of the embodiments regarding the isolation device or any component related to the isolation device (e.g., the pH maintainer) is intended to apply to all of the apparatus and method embodiments. It is to be understood that reference to "the desired pH" is meant to be synonymous with the phrase "the desired pH or range of pH values." Moreover, the use of the phrase "the desired pH or range of pH values" in one sentence and the mere use of the phrase "the desired pH" in another sentence does not mean to exclude the "range of pH values" in the other sentence.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A first section of tubing string 15 can be installed in the wellbore 11. A second section of tubing string 16 (as well as multiple other sections of tubing string, not shown) can be installed in the wellbore 11. The well system 10 can comprise at least a first zone 13 and a second zone 14. The well system 10 can also include more than two zones, for example, the well system 10 can further include a third zone, a fourth zone, and so on. The well system 10 can further include one or more packers 18. The packers 18 can be used in addition to the isolation device to isolate each zone of the wellbore 11. The isolation device can be the packers 18. The packers 18 can be used to prevent fluid flow between one or more zones (e.g., between the first zone 13 and the second zone 14) via an annulus 19. The tubing string 15/16 can also include one or more ports 17. One or more ports 17 can be located in each section of the tubing string. Moreover, not every section of the tubing string needs to include one or more ports 17. For example, the first section of tubing string 15 can include one or more ports 17, while the second section of tubing string 16 does not contain a port. In this manner, fluid flow into the annulus 19 for a particular section can be selected based on the specific oil or gas operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

According to an embodiment, the isolation device is capable of restricting or preventing fluid flow between a first zone 13 and a second zone 14. The first zone 13 can be located upstream or downstream of the second zone 14. In this manner, depending on the oil or gas operation, fluid is restricted or prevented from flowing downstream or upstream into the second zone 14. Examples of isolation devices capable of restricting or preventing fluid flow between zones include, but are not limited to, a ball and seat, a plug, a bridge plug, a wiper plug, and a packer.

As can be seen in FIG. 1, the first section of tubing string 15 can be located within the first zone 13 and the second section of tubing string 16 can be located within the second zone 14. The wellbore isolation device can be a ball, a plug, a bridge plug, a wiper plug, or a packer. The wellbore isolation device can restrict fluid flow past the device. The wellbore isolation device may be a free falling device, may be a pumped-down device, or it may be tethered to the surface. As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string. When the first section of tubing string 15 is located below the second section of tubing string 16, then the inner diameter (I.D.) of the first seat 41 can be less than the I.D. of the second seat 42. In this manner, a first ball 31 can be placed into the first section of tubing string 15. The first ball 31 can have a smaller diameter than a second ball 32. The first ball 31 can engage a first seat 41. Fluid can now be temporarily restricted or prevented from flowing into any zones located downstream of the first zone 13. In the event it is desirable to temporarily restrict or prevent fluid flow into any zones located downstream of the second zone 14, the second ball 32 can be placed into second section of tubing string 16 and will be prevented from falling into the first section of tubing string 15 via the second seat 42 or because the second ball 32 has a larger outer diameter (O.D.) than the I.D. of the first seat 41. The second ball 32 can engage the second seat 42. The ball (whether it be a first ball 31 or a second ball 32) can engage a sliding sleeve 50 during placement. This engagement with the sliding sleeve 50 can cause the sliding sleeve to move; thus, opening a port 17 located adjacent to the seat. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular zone. As such, a fluid can be produced from the subterranean formation 20 or injected into the formation.

Figure 2:
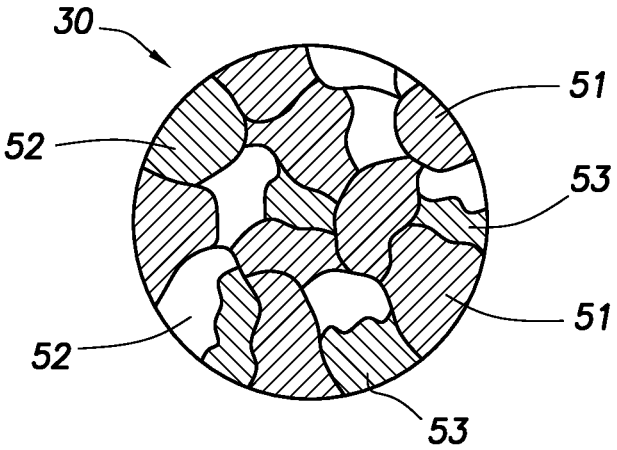
FIGS. 2 and 3 are schematic illustrations of an isolation device according to different embodiments.
Figure 3:
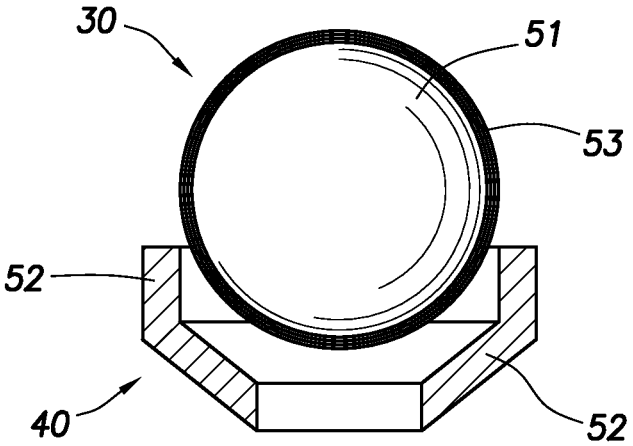

Referring to FIGS. 2 and 3, the isolation device comprises the substance 51 and the pH maintainer 53. The substance 51 can be any substance that decomposes via chemical decomposition. The chemical decomposition can be without limitation hydrolysis, an oxidation-reduction, galvanic corrosion, or an acid-base reaction of the substance. An example of a substance that decomposes via hydrolysis in water is magnesium. In water, magnesium undergoes hydrolytic decomposition to form magnesium hydroxide "$Mg(OH)_2$" and hydrogen "$H_2$" gas. However, when magnesium hydrolyzes into $Mg(OH)_2$, the pH of the surrounding water increases, which can halt or slow the hydrolysis of unhydrolyzed magnesium. By way of another example, a substance that undergoes galvanic corrosion is aluminum when an electrically conductive path exists between the aluminum and a second substance of a different metal or metal alloy and both substances are in contact with an electrolyte. However, when aluminum galvanically corrodes, the pH of the electrolyte can become neutral, which can halt or slow the galvanic corrosion of any un-corroded aluminum anode.

The substance 51 can be selected from the group consisting of a plastic, a metal, a metal alloy, and combinations thereof. The metal or metal of the metal alloy can be selected from the group consisting of, lithium, sodium, potassium, rubidium, cesium, francium, beryllium, magnesium, calcium, strontium, barium, radium, aluminum, gallium, indium, tin, thallium, lead, bismuth, scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold, graphite, and combinations thereof. Preferably, the metal or metal of the metal alloy is selected from the group consisting of aluminum, magnesium, manganese, zinc, and combinations thereof. According to an embodiment, the metal is neither radioactive, unstable, nor theoretical.

The isolation device 30 also includes the pH maintainer 53. The pH maintainer 53 maintains the pH of a wellbore fluid surrounding the isolation device at a desired pH or range of pH values for a desired period of time, wherein the substance 51 is capable of decomposing at the desired pH or range of pH values. The desired pH or range of pH values can be predetermined and selected based on the substance 51, such that the substance is capable of decomposing at the desired pH or range of pH values. By way of example, magnesium hydrolyzes in water when the pH of the water is in the range from −2 to about 11. By way of another example, aluminum is passive (i.e., it does not decompose) when a surrounding fluid has a pH in the range of about 4 to about 8.5, but will decompose at two different pH ranges of −2 to about 4 and about 8.5 to 14. Therefore, if magnesium is the substance 51, then the desired pH could be any pH within the range of pH values of −2 to about 11. The desired pH or range of pH values can also be selected to help prevent adverse effects to wellbore equipment due to the pH of the wellbore fluid. For example, some wellbore components can become degraded due to a very acidic environment. Moreover, films or scales can build up on wellbore components in a basic pH range. Therefore, the desired pH or range of pH values may be as close to neutral (i.e., pH of 7) as possible while still allowing the substance 51 to be capable of decomposing at that desired pH or range.

The pH maintainer 53 can be a solid at a temperature of 73° F. (21° C.) and a pressure of 1 atmosphere. The pH maintainer 53 is preferably soluble in the wellbore fluid that surrounds the isolation device 30. According to an embodiment, the pH maintainer 53 is a buffering agent. A buffering agent contains an acidic species to neutralize hydroxide ($OH^-$) ions and a basic species to neutralize hydrogen ($H^+$)ions. However, the acidic and basic species of the buffering agent should not consume each other through a neutralization reaction. The buffering agent can be a weak acid and a salt of the weak acid or a weak base and a salt of the weak base. Thus, the buffering agent can include a weak acid-base conjugate pair or weak base-acid conjugate pair, such as $HC_2H_3O_2$—$C_2H_3O_2^-$ or $NH_4^+$—$NH_3$. According to an embodiment, the buffering agent is selected such that the buffering agent's acid form has a $pK_a$ the same as or close to the desired pH or a pH within the desired range of pH values. As used herein, the term "close to" means+/−15% of the value. In this manner, the buffering agent can maintain the pH of the fluid surrounding the isolation device at the desired pH. The pH maintainer 53 can also be a strong acid or strong base. A strong acid and strong base are molecules that ionize completely in water. The pH maintainer 53 can be selected from the group consisting of polylactic acid, polyvinyl alcohol, polyvinyl acetate, polyethylene glycol, poly (p-phenylene oxide), polyglycolic acid, potassium carbonate, sodium hydroxide, potassium hydroxide, salts of any of the foregoing, and combinations thereof.

According to an embodiment, the concentration of the pH maintainer 53 is selected such that the pH of the wellbore fluid surrounding the isolation device is maintained at the desired pH or range of pH values. For a buffering agent, the total amount of the conjugate acid-base pair is selected such that the pH of the wellbore fluid is maintained at the desired pH or range of pH values. This is known as the buffering capacity of the buffering agent. The buffering capacity is the amount of acid or base the buffer can neutralize before the pH begins to change to an appreciable degree. Therefore, the greater the amount of the conjugate acid-base pair, the more resistant the pH of the wellbore fluid is to change. By way of example, a 1 liter (L) solution that is 1 molar (M) in $HC_2H_3O_2$ and 1 M in $NaC_2H_3O_2$ will have the same pH as a 1 L solution that is 0.1 M in $HC_2H_3O_2$ and 0.1 M in $NaC_2H_3O_2$; however, the first solution will have a greater buffering capacity because it contains more of the conjugate acid-base pair ($HC_2H_3O_2$ and $C_2H_3O_2^-$) than the second solution.

The isolation device 30 can further comprise a second substance 52, as shown in FIGS. 2 and 3. The second substance 52 can be a reactant in the chemical decomposition reaction between the substance 51 and the second substance 52. By way of example, for galvanic corrosion, the substance 51 and the second substance 52 can be different metals or metal alloys, wherein the substance 51 is the anode and the second substance 52 is the cathode. According to this embodiment, the wellbore fluid surrounding the isolation device can be an electrolyte. The second substance 52 can also be an oxidizer or reducer for Redox reactions.

FIGS. 2 and 3 depict the isolation device according to certain embodiments. As can be seen in the drawings, the isolation device can be a ball 30. As depicted in FIG. 2, the isolation device can comprise the substance 51, the second substance 52, and the pH maintainer 53. The isolation device 30 can also contain more than one type of pH maintainer 53. For example, a first pH maintainer 53 can be a weaker acid compared to a second pH maintainer. As can be seen in FIG. 2, the first and second substances 51/52 and the pH maintainer 53 can be nuggets of material or a powder. Although this embodiment depicted in FIG. 2 illustrates the isolation device as a ball, it is to be understood that this embodiment and discussion thereof is equally applicable to an isolation device that is a bridge plug, packer, etc. The substance 51 and the pH maintainer 53 (and optionally, the second substance 52) can be bonded together in a variety of ways, including but not limited to powder metallurgy, in order to form the isolation device. At least a portion of the outside of the nuggets of the substance 51 can be in direct contact with at least a portion of the outside of the nuggets of the second substance 52. By contrast, the outside of the nuggets of the substance 51 do not have to be in direct contact with the outside of the nuggets of the second substance 52. For example, the pH maintainer 53 can be an intermediary substance located between the outsides of the nuggets of the first and second substances 51/52. As can be seen, as the wellbore fluid contacts the pH maintainer 53, the pH maintainer can dissolve in the fluid. The decomposition of the substance 51 can form an acid or base in the wellbore fluid (depending on the substance 51). The dissolution of the pH maintainer 53 prevents changes to the pH of the wellbore fluid to an appreciable amount and thus, maintains the pH of the wellbore fluid at the desired pH or range of pH values despite the formation of the acid or base. The substance 51 can continue to decompose due to the maintenance of the pH of the wellbore fluid and providing other conditions exist that allow the decomposition reaction to proceed (e.g., for galvanic corrosion—there is still unconsumed cathode material and free ions available in the electrolyte). As the substance 51 continues to decompose and form more acid or base in the fluid, more of the pH maintainer 53 is exposed to the wellbore fluid to enable dissolution. The process can continue in this fashion until the majority or all of the substance 51 of the isolation device 30 has decomposed.

FIG. 3 depicts the isolation device according to other embodiments. As can be seen in FIG. 3, the isolation device, such as a ball 30, can be made of the substance 51. The pH maintainer 53 can be a layer that coats the outside of the substance 51. There can also be multiple layers of the substance 51 and the pH maintainer 53, wherein the substance and the pH maintainer can be the same or different for each layer. At least a portion of a seat 40 can comprise the second substance 52. According to this embodiment, at least a portion of the substance 51 of the ball 30 can come in contact with at least a portion of the second substance 52 of the seat 40. Although not shown in the drawings, according to another embodiment, at least a portion of a tubing string can comprise the second substance 52. This embodiment can be useful for a ball, bridge plug, packer, etc. isolation device. Preferably, the portion of the tubing string that comprises the second substance 52 is located adjacent to the isolation device comprising the substance 51. More preferably, the portion of the tubing string that comprises the second substance 52 is located adjacent to the isolation device comprising the substance 51 after the isolation device is situated in the desired location within the wellbore 11. The portion of the tubing string that comprises the second substance 52 is preferably located within a maximum distance to the isolation device comprising the substance 51.

The maximum distance can be a distance such that chemical decomposition of the substance 51 can occur, for example, that an electrically conductive path exists between the substance 51 and the second substance 52. The layer(s) of the pH maintainer 53 can function very much like the nuggets or powdered form of the pH maintainer from FIG. 2, in which as the substance 51 decomposes, additional pH maintainer 53 is exposed to dissolve in the wellbore fluid to maintain the pH of the fluid at the desired pH or range of pH values.

If the isolation device 30 comprises different types of pH maintainer 53 or multiple nuggets or layers of pH maintainer, then each type of pH maintainer, size of the nuggets, and thickness of the layers can be selected to provide multiple desired pH values or range of pH values for desired periods of time. The following are some examples of using multiple layers of pH maintainer 53 in wellbore operations. The following examples are not the only examples that could be given and are not meant to limit the scope of embodiments disclosed herein.

Example 1: a first layer of pH maintainer 53 can be located around the perimeter of the substance 51. The first layer can dissolve when in contact with the wellbore fluid surrounding the isolation device 30. The thickness of the layer can be selected such that a small amount of a conjugate acid-base pair exists as the pH of the wellbore fluid is likely to already be at the desired pH. After the first layer of pH maintainer 53 has dissolved, the substance 51 is now exposed to decompose. During decomposition, the decomposed substance 51 can form an acid or base. The dissolved pH maintainer keeps the pH of the wellbore fluid at the desired pH despite the formation of the acid or base. As the substance continues to decompose, additional layers of pH maintainer 53 can be exposed to dissolve in the fluid to maintain the pH of the wellbore fluid.

Example 2: a first layer of pH maintainer 53 can be located around the perimeter of the substance 51. The first layer can have a thickness such that the desired pH is around 8.5, for example. After the first layer of pH maintainer 53 has dissolved, the substance 51 is now exposed to decompose. During decomposition, the decomposed substance 51 can form an acid or base. The dissolved pH maintainer keeps the pH of the wellbore fluid around 8.5. However, depending on the thickness of the layer of the substance 51, the pH may fall below or raise above 8.5. A second layer of pH maintainer 53 can have a greater thickness than the first layer of pH maintainer 53. The thicker layer means that more of the pH maintainer 53 is available to maintain the pH of the wellbore fluid at around 8.5. In this manner, the thickness of all layers (or cross-sectional size of the nuggets with reference to FIG. 2) can be selected to keep the pH of the wellbore fluid at the desired pH.

Example 3: a first layer of pH maintainer 53 can be located around the perimeter of the substance 51. The first layer can have a thickness such that the desired pH is around 8.5, for example. After the first layer of pH maintainer 53 has dissolved, the substance 51 is now exposed to decompose. During decomposition, the decomposed substance 51 can form an acid or base. The dissolved pH maintainer keeps the pH of the wellbore fluid around 8.5. However, it may be desirable to control or alter (i.e., increase or decrease) the decomposition rate of the substance 51. Example 2 would be an example of controlling the rate of the decomposition reaction by maintaining the pH of the wellbore fluid at the same value or range of values. However, the thickness of the layers can be used to alter the decomposition rate of the substance 51. For example, the type of pH maintainer 53 can be different for each layer or different for a few layers. A stronger acid or base could be used in subsequent layers, which would decrease or increase, respectively, the pH of the wellbore fluid. This change in pH could then speed up or increase the decomposition rate of the substance 51. For example, aluminum would experience a faster decomposition when the pH of the fluid moves from neutral towards −2 and 14. Alternatively, a weaker acid or base could be used, which would change the pH of the wellbore fluid. This change in pH could then slow down or decrease the decomposition rate of the substance. As can be appreciated by those skilled in the art, several factors can be adjusted (e.g., the type of pH maintainer, the location of the pH maintainer, the amount of reactive components of the pH maintainer, the layer thickness and/or cross-sectional size of the nuggets of the pH maintainer) to provide a controlled or altered decomposition rate of the substance 51. Additionally, each layer can maintain the pH of the wellbore fluid at the desired pH for a desired period of time. The desired period of time can be at least long enough such that the substance 51 continues to decompose. The desired period of time can also be a time wherein the substance 51 ceases to decompose. According to this embodiment, additional pH maintainer 53 is then exposed to dissolve in the wellbore fluid to bring the pH of the fluid back to the desired pH or range of pH values such that the substance 51 resumes decomposition. This embodiment may also be useful to help control the total length of time that it takes for the majority or all of the substance 51 to decompose.

The methods include causing or allowing at least a portion of the substance 51 to decompose. At least a portion of the substance 51 can decompose in a desired amount of time. The desired amount of time can be pre-determined, based in part, on the specific oil or gas well operation to be performed. The desired amount of time can be in the range from about 1 hour to about 2 months. The desired pH or range of pH values can be selected such that the substance 51 decomposes in the desired amount of time.

According to an embodiment, at least the substance 51 is capable of withstanding a specific pressure differential (for example, the isolation device depicted in FIG. 3). As used herein, the term "withstanding" means that the substance does not crack, break, or collapse. The pressure differential can be the downhole pressure of the subterranean formation 20 across the device. As used herein, the term "downhole" means the location within the wellbore where the substance 51 is located. Formation pressures can range from about 1,000 to about 30,000 pounds force per square inch (psi) (about 6.9 to about 206.8 megapascals "MPa"). The pressure differential can also be created during oil or gas operations. For example, a fluid, when introduced into the wellbore 11 upstream or downstream of the substance, can create a higher pressure above or below, respectively, of the isolation device. Pressure differentials can range from 100 to over 10,000 psi (about 0.7 to over 68.9 MPa). According to another embodiment, both, the first and second substances 51/52 are capable of withstanding a specific pressure differential (for example, the isolation device depicted in FIG. 2).

The methods include placing the isolation device into the wellbore 11. More than one isolation device can also be placed in multiple portions of the wellbore. The methods can further include the step of removing all or a portion of the decomposed substance 51 and/or all or a portion of the second substance 52, wherein the step of removing is performed after the step of allowing the at least a portion of the substance to decompose. The step of removing can include flowing the decomposed substance 51 and/or the second substance 52 from the wellbore 11. According to an embodiment, a sufficient amount of the substance 51 decomposes such that the isolation device is capable of being flowed from the wellbore 11. According to this embodiment, the isolation device should be capable of being flowed from the wellbore via decomposition of the substance 51, without the use of a milling apparatus, retrieval apparatus, or other such apparatus commonly used to remove isolation devices. According to an embodiment, after decomposition of the substance 51, the substance has a cross-sectional area less than 0.05 square inches, preferably less than 0.01 square inches.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of removing a wellbore isolation device comprising:

placing the wellbore isolation device into the wellbore, wherein the isolation device comprises:

(A) a first substance and a second substance at least partially different from the first substance; wherein the first substance is selected from the group consisting of a metal, a metal alloy, and combinations thereof; wherein the second substance is selected from the group consisting of a metal, a metal alloy, and combinations thereof; the selections reacting galvanically for corrosion of at least one of the first and second substance; and (B) a pH maintainer integrated with the first substance and the second substance, wherein the pH maintainer maintains the pH of a wellbore fluid surrounding the isolation device at a desired pH or range of pH values for a desired period of time, and wherein the at least one corroded substance is capable of decomposing at the desired pH or range of pH values; wherein the desired pH or range of pH values is about 2 to about 8.5; and causing or allowing at least a portion of the at least one corroded substance to decompose.

2. The method according to claim 1, wherein the isolation device is capable of restricting or preventing fluid flow between a first zone and a second zone of the wellbore.

3. The method according to claim 1, wherein the isolation device is a ball and a seat, a plug, a bridge plug, a wiper plug, or a packer.

4. The method according to claim 1, wherein the metal or metal of the metal alloy is selected from the group consisting of aluminum, magnesium, manganese, zinc, and combinations thereof.

5. The method according to claim 1, wherein the pH maintainer is a solid at a temperature of 73° F. and a pressure of 1 atmosphere.

6. The method according to claim 1, wherein the pH maintainer is soluble in the wellbore fluid that surrounds the isolation device.

7. The method according to claim 1, wherein the pH maintainer is a buffering agent.

8. The method according to claim 7, wherein the buffering agent is selected such that the buffering agent's acid form has a $pK_a$ the same as or close to the desired pH or a pH within the desired range of pH values.

9. The method according to claim 1, wherein the pH maintainer is a strong acid or strong base.

10. The method according to claim 1, wherein the pH maintainer is selected from the group consisting of polylactic acid, polyvinyl alcohol, polyvinyl acetate, polyethylene glycol, poly(p-phenylene oxide), polyglycolic acid, potassium carbonate, sodium hydroxide, potassium hydroxide, salts of any of the foregoing, and combinations thereof.

11. The method according to claim 1, further comprising the step of removing all or a portion of the decomposed substance, wherein the step of removing is performed after the step of allowing the at least a portion of the substance to decompose.

12. A wellbore isolation device comprising:

a first substance and a second substance at least partially different from the first substance; wherein the first substance is selected from the group consisting of a metal, a metal alloy, and combinations thereof; wherein the second substance is selected from the group consisting of a metal, a metal alloy, and combinations thereof; the selections reacting galvanically for corrosion of at least one of the first and second substance; and a pH maintainer integrated with the first substance and the second substance, wherein the pH maintainer maintains the pH of a wellbore fluid surrounding the isolation device at a desired pH or range of pH values for a desired period of time, wherein the desired pH or range of pH values is about 2 to about 8.5, and wherein the at least one corroded substance is capable of decomposing at the desired pH or range of pH values.

13. The device according to claim 12, wherein the pH maintainer is a buffering agent.

14. The device according to claim 13, wherein the buffering agent is selected such that the buffering agent's acid form has a $pK_a$ the same as or close to the desired pH or a pH within the desired range of pH values.

15. The device according to claim 12, wherein the pH maintainer is a strong acid or strong base.

16. The device according to claim 12, wherein the pH maintainer is selected from the group consisting of polylactic acid, polyvinyl alcohol, polyvinyl acetate, polyethylene glycol, poly(p-phenylene oxide), polyglycolic acid, potassium carbonate, sodium hydroxide, potassium hydroxide, salts of any of the foregoing, and combinations thereof.

* * * * *